US005544691A

United States Patent [19]

Wandio

[11] Patent Number: 5,544,691

[45] Date of Patent: Aug. 13, 1996

[54] REVERSING MECHANISM FOR AN OVERHEAD DOOR OPENER

[76] Inventor: Raymond Wandio, 10506- 80 Street, Edmonton, Alberta, Canada, T6A 3J7

[21] Appl. No.: 444,747

[22] Filed: May 19, 1995

[30] Foreign Application Priority Data

May 20, 1994 [CA] Canada ..... 2124222

[51] Int. Cl.[6] ..... E05F 11/00; E05F 15/02; E06B 3/48; E06B 9/17

[52] U.S. Cl. ..... 160/188; 160/189; 160/200; 160/318; 49/28; 49/199; 49/200

[58] Field of Search ..... 160/188, 318, 160/201; 49/26, 28, 199, 200

[56] References Cited

U.S. PATENT DOCUMENTS

| | | | |
|---|---|---|---|
| 2,335,336 | 11/1943 | Zoller | 268/59 |
| 2,589,479 | 3/1952 | Curtis | 268/59 |
| 2,634,124 | 4/1953 | Davis | 268/42 |
| 2,687,298 | 8/1954 | Maple | 268/74 |
| 2,789,636 | 4/1957 | Lawick | 160/188 |
| 3,104,910 | 9/1963 | Kappen | 296/51 |
| 3,240,484 | 3/1966 | Klamp | 268/59 |
| 3,683,710 | 8/1972 | MacFarland | 160/188 |
| 3,695,332 | 10/1972 | Bahnsen | 160/188 |
| 3,797,171 | 3/1974 | Farmer | 160/188 |
| 3,934,635 | 1/1976 | Kin | 160/189 |
| 3,955,661 | 5/1976 | Popper et al. | 160/188 |
| 4,611,430 | 9/1986 | Altrogge | 49/199 |
| 4,860,813 | 8/1989 | Ballyns et al. | 296/50 |
| 4,891,908 | 1/1990 | Aquilina | 49/199 |
| 5,056,847 | 10/1991 | Stillwell et al. | 296/50 |
| 5,253,451 | 10/1993 | Hormann | 49/199 |
| 5,323,876 | 6/1994 | McAllister et al. | 187/53 |

*Primary Examiner*—Brian K. Green
*Assistant Examiner*—Bruce A. Lev
*Attorney, Agent, or Firm*—Anthony R. Lambert

[57] ABSTRACT

A reversing mechanism for an overhead door opener is described. The reversing mechanism includes a channel-form trolley track. A centrally positioned longitudinal slot extends for the length of a bottom of the trolley track. Side openings are provided at a first end and the second end of the trolley track. A trolley plate is positioned in the trolley track with a control arm edge extending through the slot. A chain/cable return guide having an axial chain/cable receiving passage is secured to one of the opposed faces of the trolley plate. Channel engaging guide blocks project from opposed faces of the trolley plate to engage a top and the bottom of the trolley track thereby preventing the trolley plate from being withdrawn through the slot. A chain/cable is extended through the axial chain/cable receiving passage of the chain/cable return guide, looped into the trolley track from the first end and the second end and secured to the trolley plate. Limit switches are positioned adjacent the first end and second end of the trolley track. Each of the limit switches has an activating lever extending through the openings into the trolley track. The limit switches are activated upon the activating lever being struck by the channel engaging guide blocks as the trolley moves along the trolley track.

5 Claims, 4 Drawing Sheets

REVERSING MECHANISM FOR AN OVERHEAD DOOR OPENER

FIELD OF THE INVENTION

The present invention relates to a reversing mechanism for an overhead door opener.

BACKGROUND OF THE INVENTION

Overhead door openers are in widespread use, primary for opening garage doors. They consist of a drive motor, a chain or cable to which is attached a trolley with a control arm that is adapted to be secured to an overhead door. All overhead door openers have some form of reversing mechanism which stops the drive motor when the door reaches an open position or when the door reaches a closed position. If, for some reason, the reversing mechanism is not activated as the door reaches the open position or the closed position, the motor will keep running even though the door is fully open or fully closed. Unless someone discovers the problem and shuts the motor off, the motor will sustain damage. There are various reasons why the reversing mechanism may not be activated. One such reason is a loose chain or cable which skips over the reversing mechanism.

SUMMARY OF THE INVENTION

What is required is a reversing mechanism for an overhead door opener that is more reliable.

According to the present invention there is provided a reversing mechanism for an overhead door opener which includes a drive motor which rotates a chain to which is attached a trolley with a control arm that is adapted to be secured to an overhead door. The reversing mechanism includes a channel-form trolley track having a first end, a second end, opposed sides, a top and a bottom. One of the top and the bottom has a centrally positioned longitudinal slot extending for the length of the trolley track. Openings are provided at the first end and the second end through at least one of the opposed sides. An elongate trolley plate is provided with opposed faces, a first end, a second end, a channel edge and a control arm edge. The trolley plate is positioned in the trolley track with the control arm edge extending through the slot. A chain/cable return guide having an axial chain/cable receiving passage is secured to one of the opposed faces between the first end and the second end of the trolley plate adjacent the control arm edge. Channel engaging guide means project from the opposed faces of the trolley plate adjacent the channel edge. The channel engaging guide means engage the top and bottom of the trolley track thereby preventing the trolley plate from being withdrawn through the slot in the trolley track. Chain/cable attachment means is provided at the first end and the second end of the trolley plate, whereby a chain/cable is extended through the axial chain/cable receiving passage of the chain/cable return guide, looped into the trolley track from the first end and the second end and secured to the trolley plate. Control arm attachment means are positioned adjacent the control arm edge at the second end of the trolley plate, whereby the trolley plate is coupled by a control arm to an overhead door. Limit switches are positioned adjacent the first end and second end of the trolley track. Each of the limit switches has an activating lever extending through the openings in at least one of the opposed sides into the trolley track. The limit switches are activated upon the activating lever being struck by one of the trolley plate and the channel engaging guide means as the trolley moves along the trolley track.

The reversing mechanism, as described above, is more reliable for a number of reasons. Firstly, movement of that portion of the chain or cable not positioned within the trolley track is limited by the chain/cable guide. Secondly, movement of the trolley itself is severely limited by the trolley track. Thirdly, the activation levers for the limit switches are positioned within the trolley track where it is virtually impossible for them to be missed.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
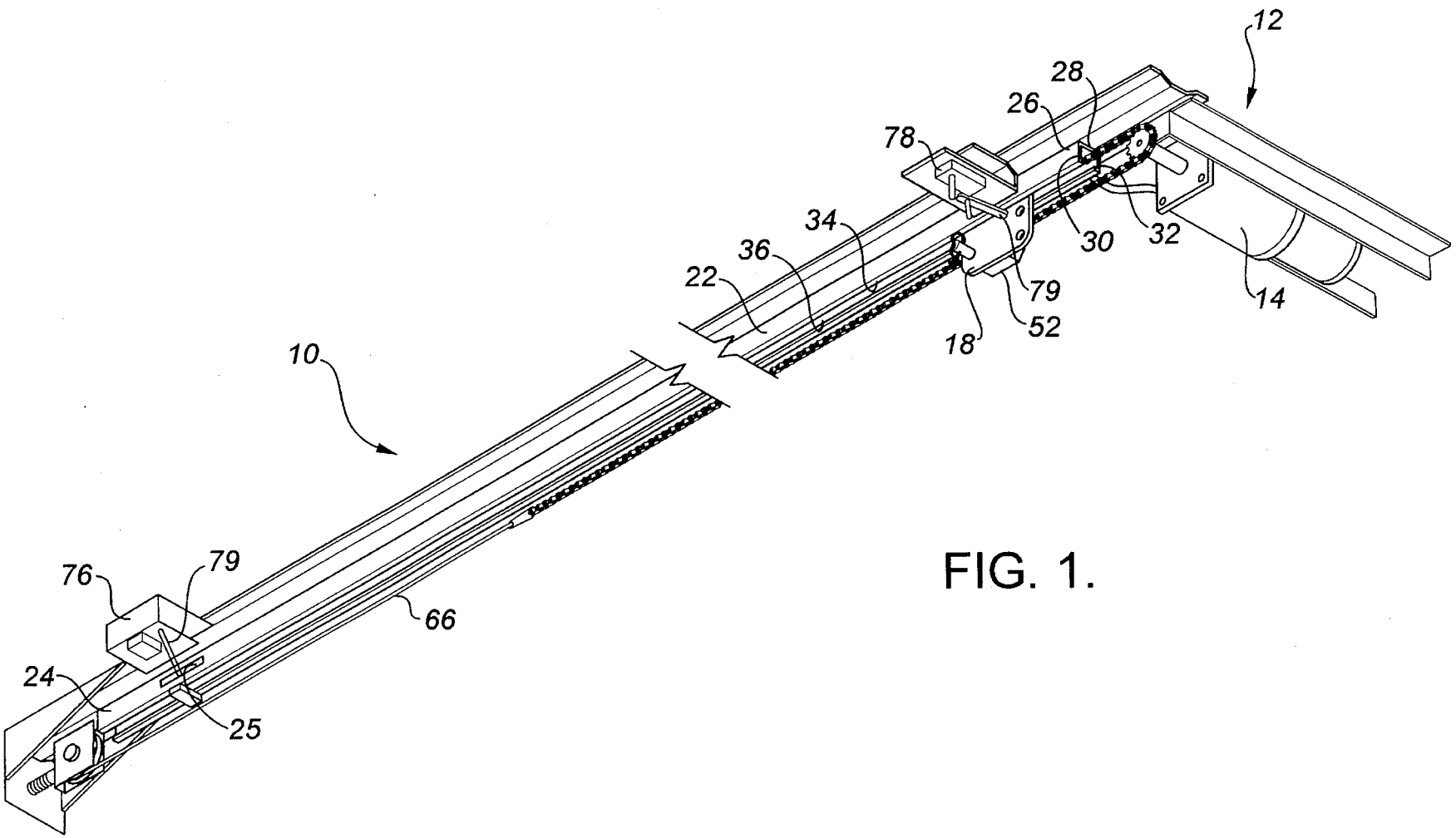
FIG. 1 is a perspective view of a reversing mechanism for a door opener constructed in accordance with the teachings of the present invention.
Figure 2:
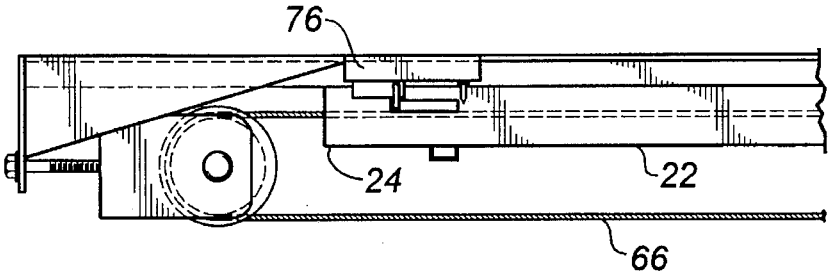
FIG. 2 is a detailed side elevation view of one end of the reversing mechanism illustrated in FIG. 1.

The preferred embodiment, a reversing mechanism for an overhead door opener generally identified by reference numeral 10, will now be described with reference to FIGS. 1 through 7.

Figure 3:
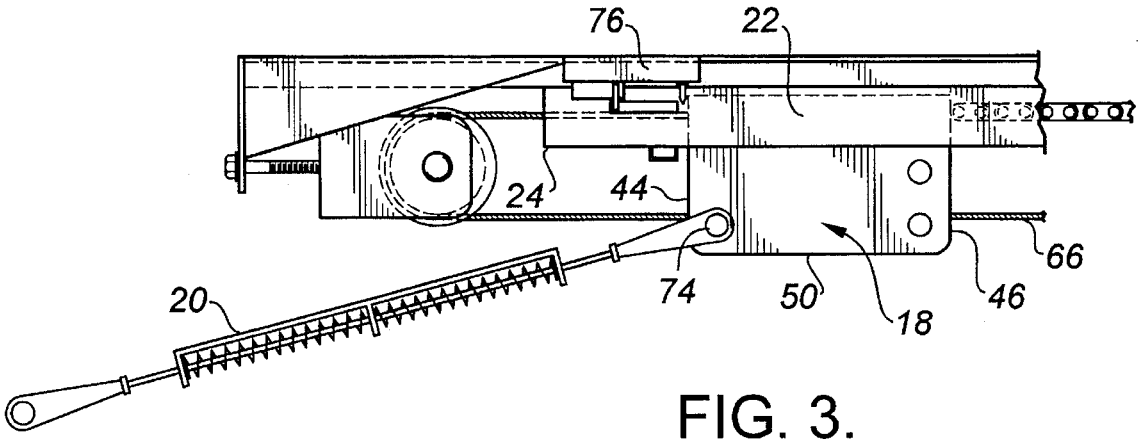
FIG. 3 is a detailed side elevation view of the same end of the reversing mechanism illustrated in FIG. 2, with a trolley portion positioned at the end.
Figure 4:
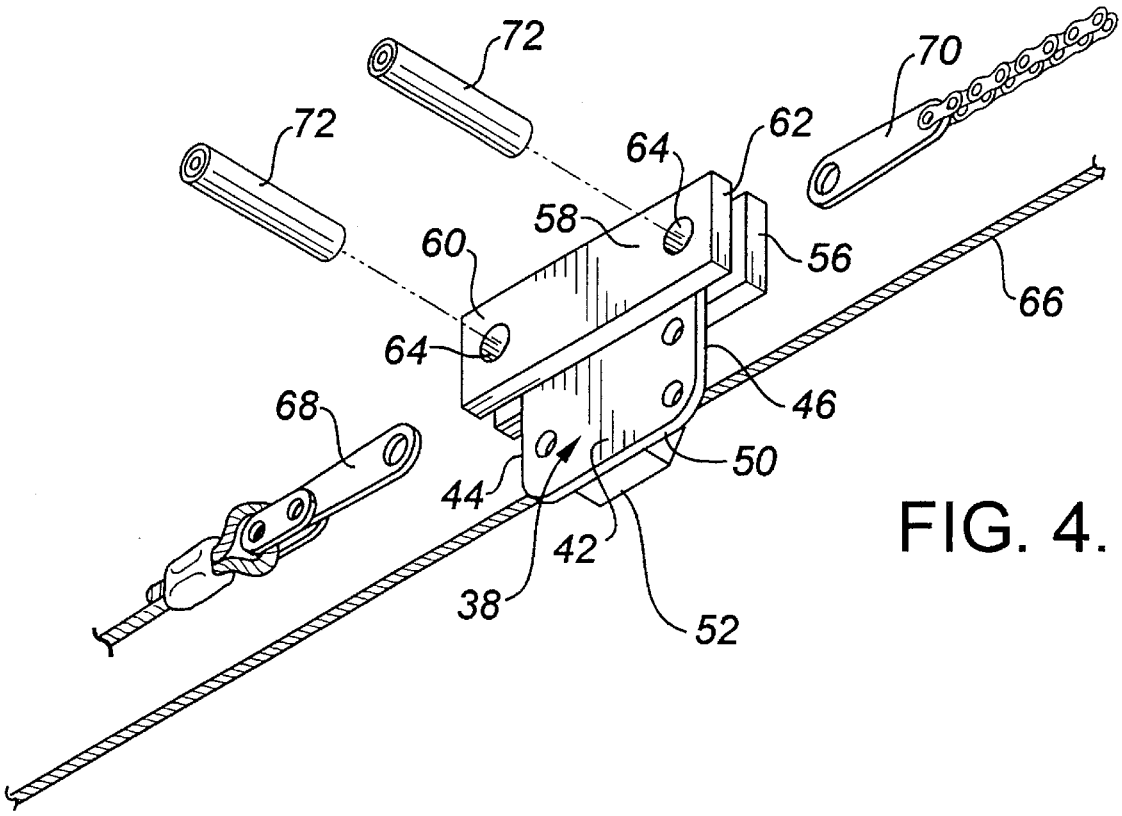
FIG. 4 is an exploded side elevation view of the trolley illustrated in FIG. 1.
Figure 5:
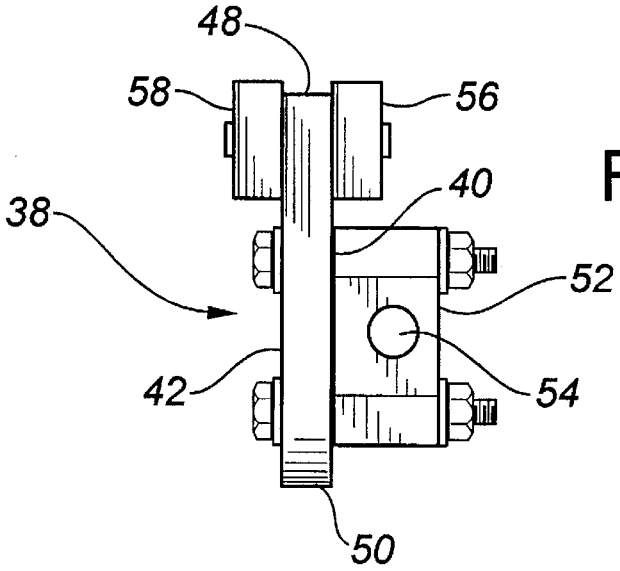
FIG. 5 is an end elevation view of the trolley illustrated in FIG. 4.
Figure 6:
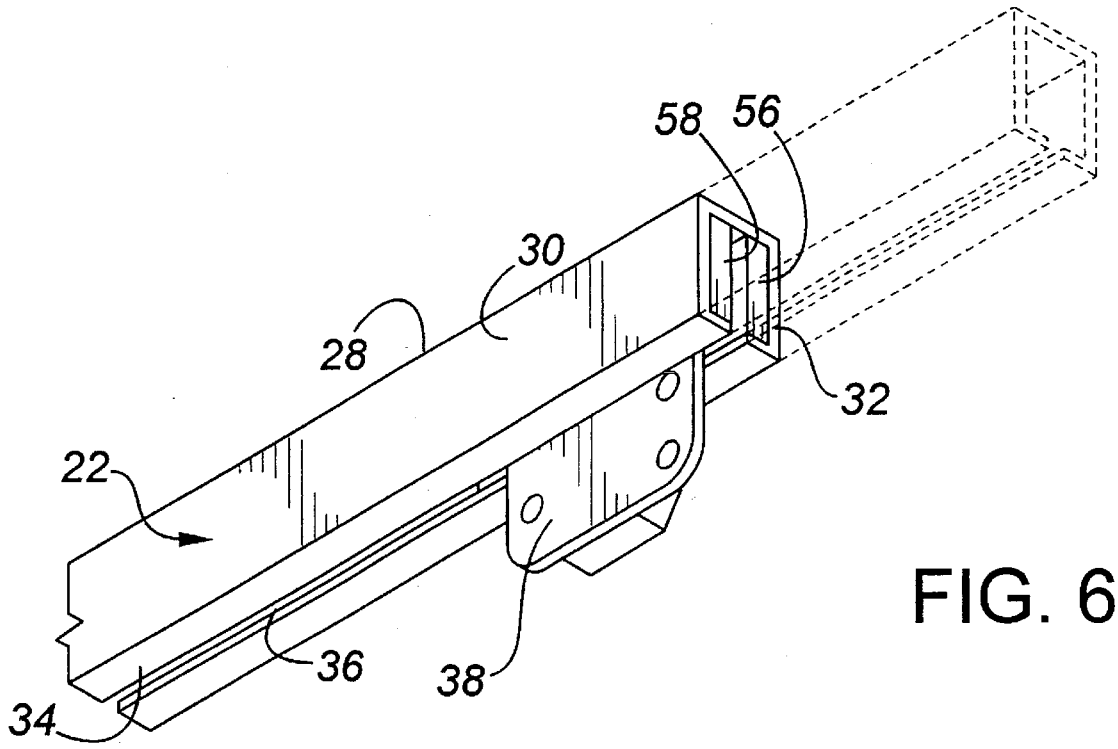
FIG. 6 is a cut away perspective view of the trolley illustrated in FIG. 5 in a trolley track.
Figure 7:
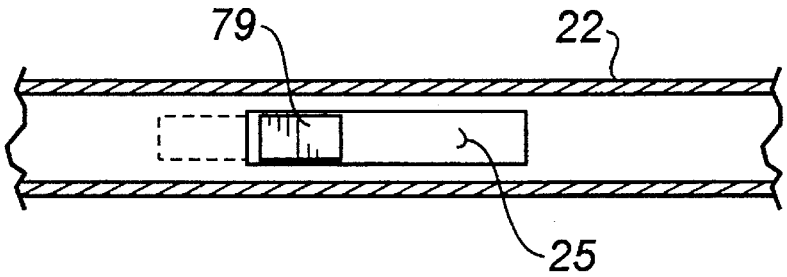
FIG. 7 is a detailed longitudinal section view of a limit switch activation lever.

Referring to FIG. 1, a door opener 12 is illustrated which includes a drive motor 14 which rotates a chain/cable 66 to which is attached a trolley 18. Referring to FIG. 3, a control arm 20 serves as the linkage between trolley 18 and an overhead door (not shown). Referring to FIG. 1, the primary elements of reversing mechanism 10 are a novel channel-form trolley track 22 and a novel form of trolley 18. Channel-form trolley track 22 has a first end 24, a second end 26, a top 28, opposed sides 30, 32 and a bottom 34. A centrally positioned longitudinal slot 36 extends for the length of trolley track 22 between first end 24 and second end 26. Trolley track 22 has openings 25 and 27 at first end 24 and second end 26, respectively. Trolley 18 consists of an elongate trolley plate 38 having a first end 44 and a second end 46 as illustrated in FIG. 4. Referring to FIG. 5, trolley plate 38 has opposed faces 40, 42, a channel edge 48 and a control arm edge 50. Referring to FIG. 1, trolley plate 38 extends through slot 36 in bottom 34 of trolley track 22, with channel edge 48 positioned within trolley track 22. Referring to FIG. 5, a nylon chain/cable guide block 52 having an axial chain/cable receiving passage 54 is secured opposed face 40 between first end 44 and second end 46 and adjacent control arm edge 50. Channel engaging metal guide blocks 56, 58 project from opposed faces 40 and 42, respectively, of trolley plate 38 adjacent channel edge 48. Referring to FIG. 6, channel guide blocks 56 and 58 engage bottom 34 and top 28 of trolley track 22 thereby preventing trolley plate 38 from being withdrawn through slot 36 in bottom 34. Referring to FIG. 4, channel guide blocks 56 and 58 project past first end 44 and second end 46 of trolley plate 38 to form projecting portions 60 and 62, respectively. Projecting portions 60 and 62 of channel guide blocks 56 and 58 have transverse pin receiving apertures 64. Referring to FIG. 4, chain/cable 66 has opposed ends 68 and 70 positioned between projecting portions 60 and 62, respectively, of channel guide blocks 56 and 58. Roll pins 72 extend through apertures 64 in projecting portions 60 and 62 of channel guide blocks 56 and 58 and through opposed ends 68 and 70 of chain/cable 66 thereby attaching chain/cable 66 to first end 44 and second end 46 of trolley plate 38. Referring to FIG. 1, chain/cable 66 extends through axial chain/cable receiving passage 54 of the chain/cable return guide block 52 and is looped into trolley track 22 from first end 24 and second end 26. Referring to FIG. 3, Control arm 20 is attached by means of a projecting attachment pin 74 adjacent control arm edge 50 at first end 44 of trolley plate 38. Referring to FIG. 1, limit switches 76 and 78 are positioned at first end 24 and second end 26, respectively, of trolley track 22. Referring to FIGS. 1 and 7, each of limit switches 76 and 78 have an activating lever 79 which extends through openings 25 and 27, respectively. Limit switches 76 or 78 are activated upon activating lever 79 being struck by one of channel guide blocks 56 or 58.

The use and operation of reversing mechanism 10 will now be described with reference to FIGS. 1 through 7. Referring to FIG. 1, when drive motor 14 is activated it serves to drive continuous chain/cable 66. Trolley 18 is attached to and moves with chain/cable 66. Chain/cable 66 extends through chain/cable receiving passage 54 of nylon chain/cable guide block 52. This limits movement of chain/cable 66 and prevents a bouncing of returning chain/cable 66 from occurring which is common to other reversing mechanism configurations. Referring to FIG. 6, trolley 18 at all times remains stable within trolley track 22 as metal channel guide blocks 56 and 58 engage bottom 34 and top 28 of trolley track 22 thereby restricting lateral movement of trolley plate 38 and preventing trolley plate 38 from being withdrawn through slot 36 in bottom 34. Referring to FIG. 3, control arm 20 is secured to trolley 18. Movement of trolley 18 results in movement of the overhead door to which trolley 18 is coupled via control arm 20. Referring to FIG. 1, when trolley 18 reaches first end 24 of trolley track 22, limit switch 76 is activated. When trolley 18 reaches second end 26 of trolley track 22, limit switch 78 is activated. Activating levers 79 for limit switches 76 and 78 are physically located within trolley track 22. They are activated upon contact with channel guide blocks 56 and 58.

It will be apparent to one skilled in the art that the described features of reversing mechanism 10 greatly enhance it's reliability. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A reversing mechanism for an overhead door opener which includes a drive motor which rotates a chain to which is attached a trolley with a control arm that is adapted to be secured to an overhead door, comprising:

a. a channel-form trolley track having a first end, a second end, opposed sides, a top and a bottom, one of the top and the bottom having a centrally positioned longitudinal slot extending for the length of the trolley track, and openings at the first end and the second end through at least one of the opposed sides;

b. an elongate trolley plate having opposed faces, a first end, a second end, a channel edge and a control arm edge, the trolley plate is positioned in the trolley track with the control arm edge extending out through the slot;

c. a chain/cable return guide having an axial chain/cable receiving passage secured to one of the opposed faces between the first end and the second end of the trolley plate adjacent the control arm edge;

d. channel engaging guide means projecting from the opposed faces of the trolley plate adjacent the channel edge, the channel engaging guide means engaging the top and bottom of the trolley track thereby preventing the trolley plate from being withdrawn through the slot in the trolley track;

e. chain/cable attachment means at the first end and the second end of the trolley plate, whereby a chain/cable is extended through the axial chain/cable receiving passage of the chain/cable return guide, looped into the trolley track from the first end and the second end and secured to the trolley plate;

f. a control arm attachment means adjacent the control arm edge at the second end of the trolley plate, whereby the trolley plate is adapted to be coupled by a control arm to an overhead door; and g. limit switches adjacent to the first end and the second end of the trolley track, each of the limit switches having an activating lever extending through the openings in at least one of the opposed sides into the trolley track, such that the limit switches are activated upon the activating lever being struck by one of the trolley plate and the channel engaging guide means as the trolley moves along the trolley track.

2. The reversing mechanism for an overhead door opener as defined in claim 1, wherein the chain/cable is attached to the trolley plate with roll pins, the roll pins being confined by the opposed sides of the trolley track.

3. The reversing mechanism for an overhead door opener as defined in claim 1, wherein the channel engaging guide means are metal blocks.

4. The reversing mechanism for an overhead door opener as defined in claim 1, wherein the chain/cable guide is a nylon block.

5. A reversing mechanism for an overhead door opener which includes a drive motor which rotates a chain to which is attached a trolley with a control arm that is adapted to be secured to an overhead door, comprising:

a. a channel-form trolley track having a first end, a second end, opposed sides, a top and a bottom having a centrally positioned longitudinal slot extending for the length of the trolley track, and openings at the first end and the second end through one of the oppose sides;

b. an elongate trolley plate having opposed faces, a first end, a second end, a channel edge and a control arm edge, the trolley plate is positioned in the trolley track with the control arm edge extending out through the slot in the bottom of the trolley track;

c. a nylon chain/cable return guide block having an axial chain/cable receiving passage secured to one of the opposed faces between the first end and the second end of the trolley plate adjacent the control arm edge;

d. channel engaging metal guide blocks projecting from the opposed faces of the trolley plate adjacent the channel edge, the channel guide blocks engaging the top and bottom of the trolley track thereby preventing the trolley plate from being withdrawn through the slot in the bottom of the trolley track, the channel guide blocks projecting past the first end and the second end of the trolley plate, the projecting portions of the channel guide blocks having transverse pin receiving apertures;

e. a chain/cable extending through the axial chain/cable receiving passage of the chain/cable return guide and being looped into the trolley track from the first end and the second end with the chain/cable having opposed ends positioned between the projecting portions of the channel guide blocks;

f. roll pins extending through the apertures in the projecting portions of the channel guide blocks and through the opposed ends of the chain/cable thereby attaching the chain/cable to the first end and the second end of the trolley plate;

g. a control arm attachment adjacent the control arm edge at the second end of the trolley plate, whereby the trolley plate is adapted to be coupled by a control arm to an overhead door; and h. limit switches adjacent to the first end and the second end of the trolley track, each of the limit switches having an activating lever extending through the openings in one of the opposed sides into the trolley track, such that the limit switches are activated upon contact with the channel guide blocks as the trolley moves along the trolley track.

* * * * *